US007654850B2

(12) United States Patent
Shimizu

(10) Patent No.: US 7,654,850 B2
(45) Date of Patent: Feb. 2, 2010

(54) SHIELDED LOCKING ELECTRICAL CONNECTOR

(75) Inventor: Shinji Shimizu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 26 days.

(21) Appl. No.: 12/230,735

(22) Filed: Sep. 4, 2008

(65) Prior Publication Data

US 2009/0075518 A1 Mar. 19, 2009

(30) Foreign Application Priority Data

Sep. 4, 2007 (JP) ..... 2007-228502

(51) Int. Cl.
*H01R 13/627* (2006.01)

(52) U.S. Cl. ..... 439/352

(58) Field of Classification Search ..... 439/350, 439/352, 353, 607.01
See application file for complete search history.

(56) References Cited

U.S. PATENT DOCUMENTS

| | | | | |
|---|---|---|---|---|
| 5,011,424 | A * | 4/1991 | Simmons | 439/352 |
| 5,584,718 | A * | 12/1996 | Sukegawa | 439/352 |
| 5,759,058 | A * | 6/1998 | Childs et al. | 439/352 |
| 6,146,182 | A * | 11/2000 | Wang et al. | 439/357 |
| 7,004,792 | B2 * | 2/2006 | Shimizu | 439/607.36 |
| 7,033,218 | B2 * | 4/2006 | Huang et al. | 439/607.04 |
| 7,217,158 | B2 * | 5/2007 | Shimizu | 439/607.23 |
| 7,591,664 | B2 * | 9/2009 | Nomiyama et al. | 439/352 |
| 7,594,827 | B2 * | 9/2009 | Takamoto et al. | 439/660 |

FOREIGN PATENT DOCUMENTS

| | | |
|---|---|---|
| JP | 60-19159 U | 2/1985 |
| JP | 01-100385 U | 7/1989 |
| JP | 2003-243093 | 8/2003 |
| JP | 3109493 U | 5/2005 |
| JP | 2005-158630 | 6/2005 |
| JP | 3109782 U | 6/2005 |
| JP | 2006-286506 | 10/2006 |

* cited by examiner

*Primary Examiner*—Edwin A. Leon
*Assistant Examiner*—Vanessa Girardi
(74) *Attorney, Agent, or Firm*—Kubotera & Associates, LLC

(57) ABSTRACT

An electrical connector connects to a mating connector in a first direction. The electrical connector includes a housing, a plurality of terminals, a terminal arrangement board made of an electrical insulator for aligning and holding the terminals, and a metal plate attached to the housing at a position facing both surfaces of the terminal arrangement board for connecting to the mating connector. The metal plate has a lock portion at a position facing one surface of the terminal arrangement board. The lock portion engages a latch portion of the mating connector in the first direction when the electrical connector is connected to the mating connector. The metal plate has an elastic pressing portion at a position facing the other surface of the terminal arrangement board. The elastic pressing portion presses the mating connector in a second direction perpendicular to the first direction when the electrical connector is connected to the mating connector.

6 Claims, 5 Drawing Sheets

SHIELDED LOCKING ELECTRICAL CONNECTOR

BACKGROUND OF THE INVENTION AND RELATED ART STATEMENT

The present invention relates to an electrical connector.

Among conventional electrical connectors (connectors), some connectors have a locking structure in order to prevent coming off of the both connectors from each other, when the connectors are connected to each other.

One of the connectors having the locking structure, for example, is disclosed in a Japanese Patent Publication. The conventional connector disclosed in the Patent Publication has a protrusion for latching together with a pit formed in a mating connector, thus the locking structure is configured with the protrusion and the pit of the mating connector.

Patent Reference: Japanese Patent Publication No. 2005-158630

Above-mentioned conventional connector has a shield case made of metal is fitted to the mating connector at a connecting part thereof. The shield case has the protrusion at adjacent part of an upper side of the connecting part thereof for latching together with the pit formed inside of a shield case of the mating connector. The protrusion has an elastic belt-like part having a fixed-fixed beam style, and the central part of the belt-like part protrudes upward in between ditches cut on both sides of the belt-like part along direction of connecting of the connectors. Therefore, the protrusion displaces elastically during a connecting operation with the mating connector. When the connecting process is completed, the elastic displacement is released and the protrusion is latched together with the pit of the mating connector. For this reason, coming off of each connector can be prevented.

The conventional connector in the Patent Publication, when the connectors are connected, the protrusion can move in up-and-down direction of the connectors against the pit of the mating connector as much as a distance generated between the both connectors, in other words, a play. By moving of the protrusion, a connection can be unstable due to insufficient work of the locking structure of the both connectors. Furthermore, the connectors can come off with a slight external force. Accordingly, it has been necessary to improve the locking structure of the conventional connectors.

In view of the problems described above, an object of the present invention is to provide an electrical connector having a stable connection state and reinforcing prevention of coming off of the connectors sufficiently.

SUMMARY OF THE INVENTION

According to the present invention, an electrical connector connects with a mating connector in a first direction. The electrical connector includes a housing, a plurality of terminals, a terminal arrangement board made of electrical insulator for aligning and holding the terminals and a metal plate fixed to the housing at a position facing to both surfaces of the terminal arrangement board for connecting to a mating connector. The metal plate has a lock portion at a position facing to one surface of the terminal arrangement board thereof. The lock portion is latched together with a latch portion of the mating connector in the first direction when the electrical connector is connected to the mating connector. The metal plate has an elastic pressing portion at a position facing to another surface of the terminal arrangement board thereof. The elastic pressing portion presses the mating connector in a second direction which is perpendicular to the first direction when the electrical connector is connected to the mating connector.

In the electrical connector described above, the elastic pressing portion is formed on the metal plate at the other side of the terminal arrangement board. When the electrical connector connects to the mating connector, the elastic pressing portion presses against an inside of a connecting part of the mating connector. As a result, a play between the electrical connector and the mating connector can be absorbed and the lock portion can be latched together with a latch portion of the mating connector securely. Hereby the lock portion can be latched with a strong latching force.

According to the present invention, the lock portion may have a protrusion for being latched together with the latch portion of the mating connector in the first direction when the electrical connector is connected to the mating connector. The elastic pressing portion may have a top part having a mountain-shape. When the electrical connector is connected to the mating connector, the top part displaces elastically by pressing against an inside of the mating connector. It is preferable that the protrusion and the top part of the elastic pressing portion are positioned with a gap in the first direction.

In the electrical connector which is described above, when the electrical connector is inserted into a connecting opening of the mating connector in order to connect with the mating connector, the protrusion of the lock portion and the top part of the elastic pressing portion abut to a edge of the inside of the connecting part which forms the connecting opening. As the protrusion and the elastic pressing portion enter into the inside of the connecting part, they receive resistance force in a reverse direction of the first direction. The resistance force becomes the strongest when each of the protrusion of the lock portion and the top part of the elastic pressing portion abuts against the edge. Therefore, in order to advance the electrical connector, the electrical connector needs to be inserted into the connecting opening against the resistance force.

When the electrical connector is connected to the mating connector, the protrusion of the lock portion and the top part of the elastic pressing portion can abut to the inside of the connecting part with the edge thereof in different timing by positioning them with the gap in the first direction. In other words, moments that the protrusion and the top part of the elastic pressing portion receive the resistance force are different from each other. Herewith the resistance can be reduced when the electrical connector is connected to the mating connector, compare to a case that the protrusion and the top part of the elastic pressing portion abut to the inside of the connecting part with the edge thereof at the same time by positioning them at the same position in the connecting direction of the connector. As a result, the electrical connector can be connected with the mating connector more easily.

According to the present invention, it is preferable that the metal plate has a flat surface which is parallel to the inside of the mating connector at a front part of the protrusion of the lock portion and of the elastic pressing portion in the first direction. Consequently, a frictional resistance generated by contact between the metal plate of the connector and the inside of the connecting part of the mating connector can be reduced until the protrusion of the lock portion or the top part of the elastic pressing portion, whichever is located in the front, abuts against the edge of the inside of the connecting part. Thus, a connecting operation can be easier moreover.

According to the present invention, it is preferable that the lock portion is formed as a both end fixed beam type spring and both base portions of the spring are arranged at front and rear along the first direction. By forming the lock portion as the both end fixed beam type spring, the lock portion can be stronger and fatigue caused by elastic deformation can be reduced compare to a case that the lock portion is formed as a cantilever beam type spring. When the lock portion is formed as the cantilever beam type spring, the lock portion may be bent by receiving force toward a longitudinal direction at a forefront part thereof.

According to the present invention, it is preferable that the lock portion has a slope between the protrusion and the base portion located rear side of the first direction, sloping from the base portion to the protrusion in direction of protruding of the protrusion. Accordingly, when the electrical connector has been connected to the mating connector, the inside of the connecting part of the mating connector can be pressed not only by the elastic pressing portion but also by the slope of the lock portion. Thus, the latching force of the lock portion can be stronger and the coming off of the both connectors from each other can be prevented more certainly.

According to the present invention, it is preferable that the elastic pressing portion is formed as a both end fixed beam type spring and both base portions of the spring are arranged at front and rear along the first direction. By forming the elastic pressing portion as the both end fixed beam type spring, the elastic pressing portion can be stronger thus fatigue caused by elastic deformation can be reduced, compare to a case that the elastic pressing portion is formed as a cantilever beam type spring. When the elastic pressing portion is formed as the cantilever beam type spring, the elastic pressing portion may be bent by receiving force toward a longitudinal direction at a forefront part thereof.

In the present invention, the electrical connector includes the metal plate having the lock portion on a surface along one side of the terminal arrangement board thereof and the elastic pressing portion on a surface along the another side of the terminal arrangement board thereof. The lock portion can be latched together with the latch portion of the mating connector securely by absorbing a play between the electrical connector and the mating connector as the elastic pressing portion presses against the inside of the connecting part of the mating connector when the electrical connector is connected to the mating connector. As a result, the coming off of the electrical connector from the mating connector can be prevented more certainly.

BRIEF DESCRIPTION OF THE DRAWINGS

FIGS. 5(A), 5(B) and 5(C) are sectional views of the male connector and the female connector taken along a line 5 in FIG. 1 according to the embodiment of the present invention, wherein FIG. 5(A) is a sectional view when the male connector starts connecting to the female connector. FIG. 5(B) is a sectional view when the male connector is in the halfway of the connecting to the female connector, and FIG. 5(C) is a sectional view when the male connector is connected to the female connector completely.

DETAILED DESCRIPTION OF PREFERRED EMBODIMENT

Hereunder, embodiments of the present invention will be explained with reference to the accompanying drawings.

Figure 1:
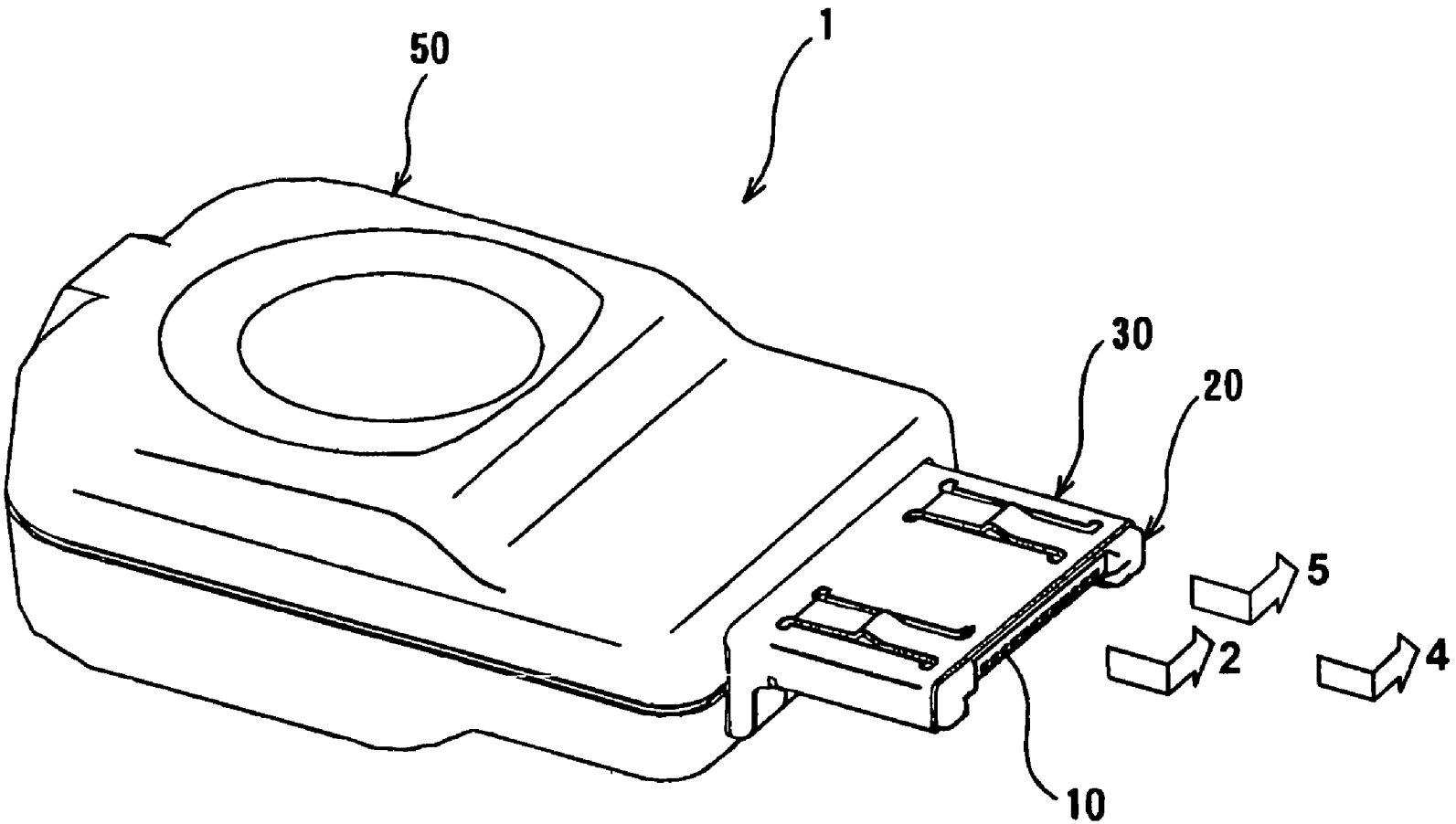
FIG. 1 is a perspective view of a male connector according to an embodiment of the present invention.

FIG. 1 is a perspective view of a male connector according to an embodiment of the present invention. As shown in FIG. 1, the male connector 1 is an electrical connector, and includes a plurality of terminals 10, a housing 20 made of electrical insulator for aligning and holding the terminals 10, a shield plate 30 made of a metal plate and fixed to the housing 20, a secondary shield plate 4D (described later), and a cover case 50 made of electrical insulator covering the housing 20, the shield plate 30, and the secondary shield plate 40.

In the present embodiment, the cover case 50 is attached to the male connector except a connecting part thereof to be connected to a female connector 2, a mating connector. As shown in FIG. 1, the male connector 1 is configured as the connecting part thereof protrudes frontward from the cover case 50 in a connecting direction of the connectors (a first direction).

Figure 2:
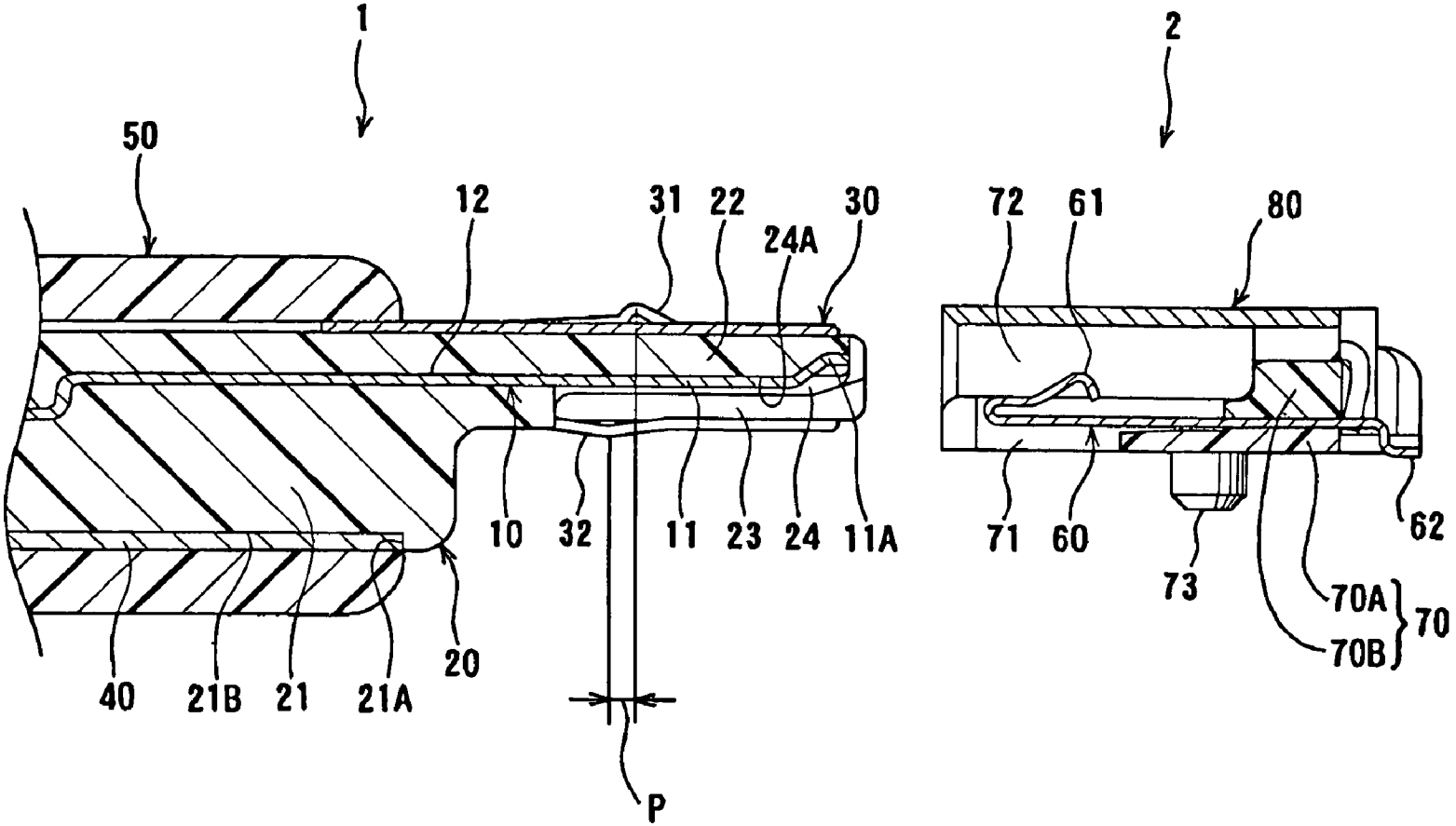
FIG. 2 is a sectional view of the male connector and a female connector taken along a line 2 in FIG. 1 according to an embodiment of the present invention.
Figure 3:
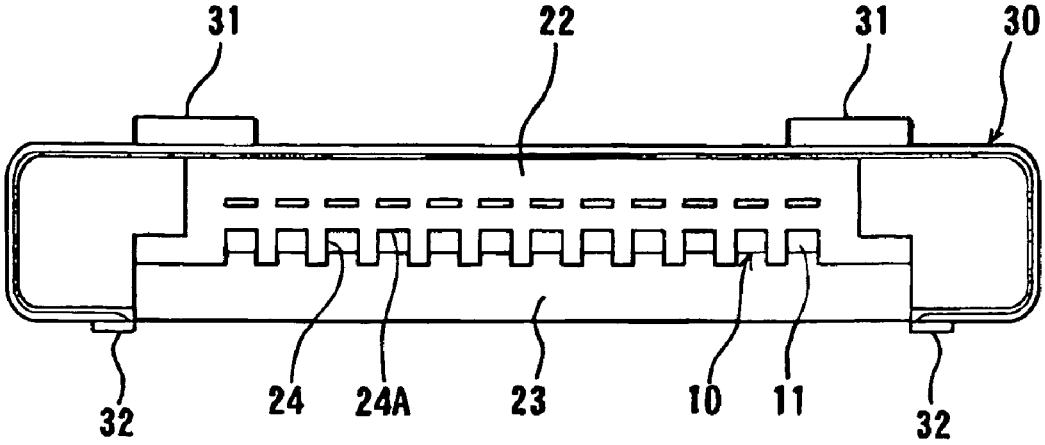
FIG. 3 is a front view of a connecting part of the male connector viewed from a side front in a connecting direction according to the embodiment of the present invention.

FIG. 2 is a sectional view of the male connector 1 and a female connector 2 taken along a line 2 in FIG. 1, according to an embodiment of the present invention. FIG. 2 shows a partial section of the male connector 1 at a position of the terminals in a direction that the terminals are arranged. In FIG. 2, a sectional view of the female connector 2 as the mating connector is also shown, together with the male connector 1. FIG. 3 is a front view of a connecting part of the male connector 1 viewed from a front side in the connecting direction. In the embodiment, a direction in which the connector faces toward the mating connector to be connected is defined as the front side, and a part located in the direction is referred to as a front part.

Hereunder, a configuration of the female connector 2 as the mating connector will be explained. The female connector 2 includes a plurality of terminals 60, a housing 70 made of electrical insulator for aligning and holding the terminals 60, and a shield plate 80 made of a metal plate fixed to the housing 70.

In the present embodiment, the terminals 60 are made of a belt-shape metal stretching backward and forward and bending in a direction which is perpendicular to a surface thereof, and are aligned on a lower side of the female connector 2. Further, each of the terminals 60 includes a contact part 61 and a connection part 62 at a front part and a rear part thereof, respectively. The contact part 61 is formed by bending the front part of the terminal 60 into a U-shape backward first and then obliquely upward, and has a mound shape at an end thereof on a rear side thereof. The connection part 62 includes a flat part formed by bending the terminal 60 into a crank shape downward at a rear part thereof, so that the flat part is to be connected to a circuit board (not shown).

In the present embodiment, the housing 70 for holding the terminals 60 is made of electrical insulator such as a synthetic resin and the like, and includes a housing main body 70A and a holding member 70B. As shown in FIG. 2, the housing 70 sandwiches and holds the terminals 61 by holding a middle part of each of the terminals 61 aligned on the housing main body 70A with the holding member 70B from above direction.

In the present embodiment, the housing 70 has a comb-like shape at a front part thereof, so that the contact parts 61 and nearby portions of the terminals 60 are retained in grooves 71 with the comb-like shape. Accordingly, the contact parts 61 can elastically displace (bend). The grooves 71 with the comb-like shape communicate with each other uprightly at front parts thereof. An opening is formed over the grooves 71 to communicate in the terminal-aligning direction and open forward, so that the opening functions as a connecting opening 72 for receiving the connecting part of the male connector 1.

In the present embodiment, each of the grooves 71 is deep enough to retain the terminal 60 therein, and the contact part 61 bent upwardly at the front side is positioned inside the connecting opening 72 with elasticity to protrude upward from the groove 71. In addition, a mounting portion 73 having a cylindrical shape is provided at a bottom of the housing 70 for mounting to the circuit board, and the female connector 2 is positioned and mounted to the circuit board by connecting the mounting portion 73 into a mounting hole provided in the circuit board.

In the present embodiment, the shield plate 80 functions as an outer wall of the female connector 2, and is bent so as to form an upper wall, side walls (walls on both ends in a direction perpendicular to a sheet in FIG. 2), and walls around edge parts on both sides at a lower surface of the female connector 2, i.e., bottom walls around parts located at both ends of a terminal-aligning portion of the housing 70. Therefore, the connecting opening 72 is formed by upper surface of the comb-like-part of the housing 70 at a middle part of the lower surface of the female connector 2, i.e., at the terminal-aligning portion, and is formed by inner surface of the shield plate 80 at the part other than the middle part.

Next, the male connector 1 according to the present embodiment will be explained. As shown in FIG. 2, the terminal 10 is made of a belt-shape metal stretching backward and forward, and includes a contact part 11 at a front thereof, a connection part (not shown) at a rear thereof, and a middle part 12 stretching in a horizontal direction between the contact part 11 and the connection part. A front end part 11A of the contact part 11 exposing a lower surface thereof is embedded onto the housing 20, and is bent obliquely upward in a front direction then in the horizontal direction. The connection part is formed by bending the terminal 10 into a crank shape downward at a rear part thereof, and then stretching toward the horizontal direction.

In the present embodiment, the housing 20 includes a main body 21 and a terminal arrangement board 22 integrated with the main body 21 and having a plate-like shape thinner than the main body 21 stretching forward, i.e., in the connecting direction. The main body 21 is covered with the cover case 50 made of a synthetic resin. The main body 21 aligns and holds the terminals 10 at the middle parts 11 and the connection parts (not shown) thereof by molding together as one part.

In the present embodiment, as shown in FIG. 3, when viewed from the front, the terminal arrangement board 22 has an upside down U character shape with a wide bottom. An opening 23 is formed at the lower side of where the terminals 10 for receiving the front part as the connecting part of the female connector 2 or the mating connector, that is, a part of the housing 70 aligning and holding the terminals 60 at the contact parts 61 thereof.

In the present embodiment, as shown in FIG. 2, the terminal arrangement board 22 includes grooves 24 formed for guiding the contact parts 61 of the terminals 60 of the female connector 2, so that the contact parts 11 of the terminals 10 are arranged and held closely at the bottom surfaces 24A of the grooves 24. The contact parts 11 are held within the depth of the grooves 24 and expose the lower surfaces thereof. Each of the terminals 10 is bent at the front parts 11A embedded in the terminal arrangement board 22, thereby avoiding a collision with the female connector 2 at the connection. In addition, since the contact parts 11 are held within the depth of the grooves 24, the contact parts 11 cannot be touched easily by a finger of a man and the like.

In the present embodiment, the shield plate 30 covers the main body 21 of the housing 20 at an upper surface and side surfaces (walls on both ends in a direction perpendicular to the sheet in FIG. 2). As shown in FIG. 3, the shield plate 30 covers the terminal arrangement board 22 at an upper surface, side surfaces, and both edges of a lower surface, namely both ends of the terminal arrangement board 22. The shield plate 30 has lock portions 31 at a side of the upper surface of the terminal arrangement board 22 for engaging with an upper inner connecting surface of the connecting opening 72 of the female connector 2 where the shield plate 30 covers the terminal arrangement board 22. Further, the shield plate 30 has elastic pressing portions 32 on a side of the lower side of the terminal arrangement board 22 for pressing a lower inner connecting surface.

In the present embodiment, the shield plate 30 is formed so as to cover not only the upper surface and lower surface of the terminal arrangement board 22, but also both sides thereof. Alternatively, the shield plate may be formed so as to cover only the upper surface and the lower surface of the terminal arrangement board 22.

In the present embodiment, the lock portions 31 are provided on the upper surface of the shield plate 30 and the elastic pressing portions 32 are provided on the lower surface thereof. Alternatively, the elastic pressing portions may be provided on the upper side, while the lock portions may be provided on the lower side. In this case, latch portions of the female connector 2 for engaging with the lock portions are provided on the lower inner surface of the connecting part of the female connector 2.

As shown FIGS. 1 and 3, two lock portions 31 are provided on the upper surface of the shield plate 30, and the lock portions 31 are positioned on the both ends of the upper surface in the direction of terminal-aligning. Two elastic pressing portions 32, as shown in FIG. 3, are positioned on the lower surface of the shield plate 30, and the elastic pressing portions 32 are positioned outside of the lock portions 31 in the direction of terminal-aligning.

Figure 4:
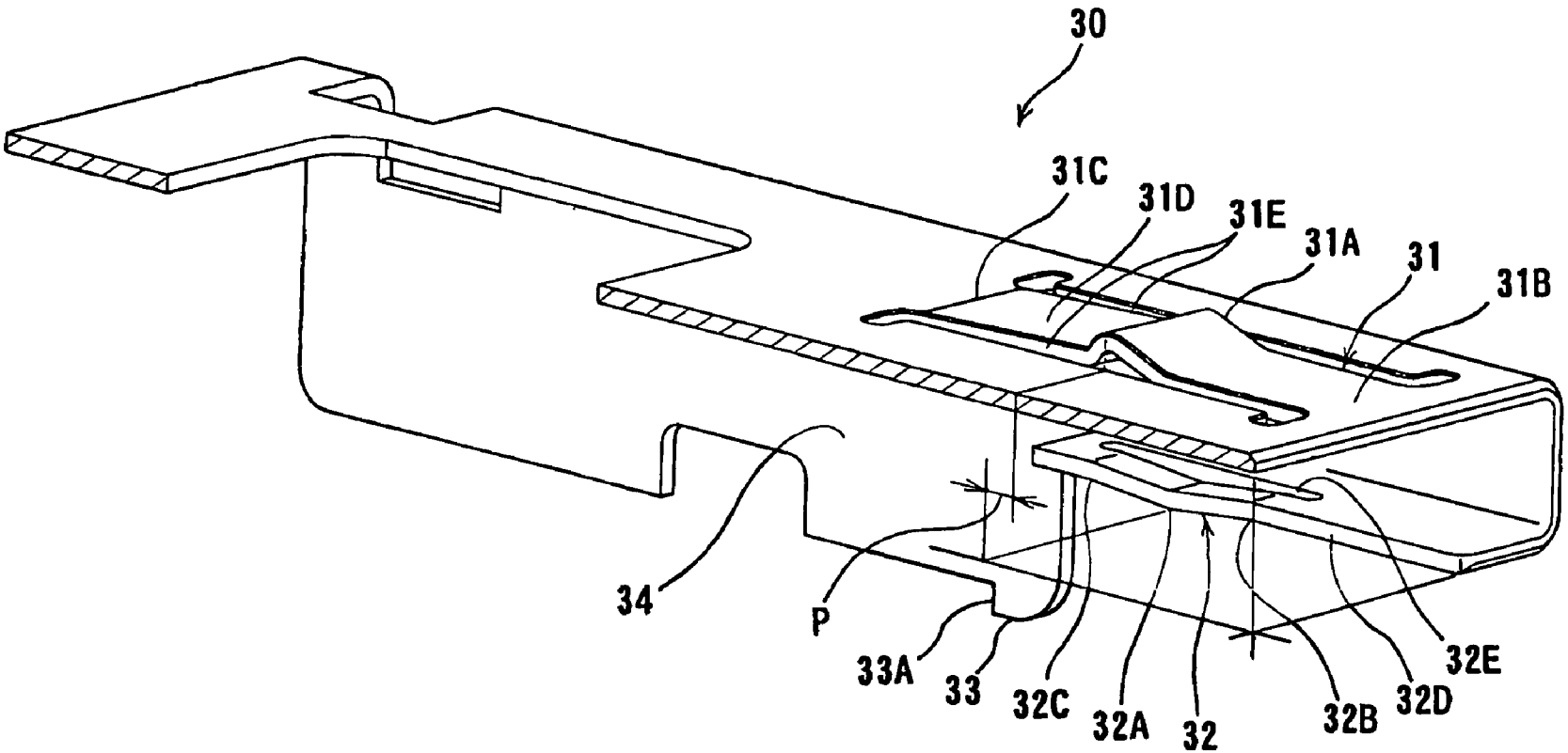
FIG. 4 is a sectional view of a shield plate of the male connector taken along a line 4 in FIG. 1 according to the embodiment of the present invention.

FIG. 4 is a sectional view of the shield plate 30 of the male connector 1 taken along a line 4 in FIG. 1. A front portion of the shield plate 30 is bent into an approximate lateral U-shape viewed from the front side so as to cover the upper surface, the side surface, and the lower surface of the terminal arrangement board 22. Additionally, in a rear side of the lateral U-shape part, the shield plate 30 includes a drooping part 34 bent to droop vertically downward at a side end thereof so as to cover the upper surface and the side surface of the main body 21. Further, a protruding portion 33 protruding downward is formed at a lower edge of a front end of the drooping part 34, and a rear end edge 33A of the protruding part 33 abuts against a frontend edge of the secondary shield plate 40 (described later).

In the present embodiment, the lock portions 31 on the upper surface of the shield plate 30 are formed as a both end fixed beam type spring with a belt-like part formed in between two grooves 31E extending in a front-back direction, i.e., in the connecting direction of the connectors. The lock portion 31 has a protrusion 31A by bending the middle part thereof upwardly. The protrusion 31A is latched together with a latching pit (described later) formed in the female connector 2 in the connecting direction of the connectors when the connectors is completely connected.

In the present embodiment, the lock portions 31 are formed of the both end fixed beam type spring. Accordingly, as compared to a case that the lock portion is formed as a cantilever beam type spring, the lock portion can be stronger, and fatigue caused by elastic deformation can be reduced. In addition, it is not necessary to consider buckling when the lock portion receives a force toward a longitudinal direction at a forefront part thereof when the lock portion is formed as the cantilever beam type spring.

However, it is obvious that the lock portion 31 may be formed of the cantilever beam type spring under a condition in which the buckling does not occur. As described later, a depressed portion is formed in the upper surface of the terminal arrangement board 22 at a position corresponding to the lock portion 31, so that the lock portion 31 bending downward can be retained the depressed portion (refer to FIG. 5(B)).

In the present embodiment, base portions 31B and 31C of the lock portion 31 are arranged at front and rear sides along the connecting direction of the connectors. Between the base portion 31C located backward of the connecting direction of the connectors and the protrusion 31A, a slope 31D is formed in the direction of protruding of the protrusion 31A, in other words, upward, sloping from the base portion 31C toward the protrusion 31A, less steeply than a slope of the protrusion 31A. A flat surface is formed from the protrusion 31A of the lock portion 31 to the base portion 31B to be flash with the upper surface of the shield case 30 except the lock portion 31.

In the present embodiment, the elastic pressing portion 32 on the lower surface of the shield case 30 is formed as a both end fixed beam type spring with a belt-like part formed between a side end edge 32D of the lower surface extending in the connecting direction of the connectors and a ditch 32E extending parallel to the side end edge 32D. As described above, by forming the elastic pressing portion 32 as the both end fixed beam type spring, the elastic pressing portion can be stronger compare to a case that the elastic pressing portion is formed as a cantilever beam type spring, thus fatigue caused by elastic deformation can be reduced. In addition, it is not necessary to consider buckling upon receiving a force toward a longitudinal direction at a forefront part thereof when the elastic pressing portion is formed as the cantilever beam type spring. The elastic pressing portion 32 may be formed as the cantilever beam type spring under a condition in which the buckling does not occur.

In the present embodiment, as shown in FIG. 4, the elastic pressing portion 32 is formed by bending into a mountain-shape having a top part 32A facing downward, and base portions 32A and 32B of the elastic pressing portion 32 are arranged at front and rear along the connecting direction of the connectors. Further, a lower surface of the shield case 30 is formed as a flat surface extending in the connecting direction of the connectors, at the front of the base portion 32B of the elastic pressing portion 32 thereof.

In the present embodiment, as shown in FIGS. 2 and 4, the protrusion 31A of the lock portion 31 and the top part 32A of the elastic pressing portion 32 are shifted with a gap in a front-back direction, i.e., in the connecting direction of the connectors. A top part of the protrusion 31A is positioned in the front of the top part 32A of the elastic pressing portion 32 by the gap P in the connecting direction of the connectors.

In the present embodiment, as shown in FIG. 2, the main body 21 of the housing 20 includes a depression 21B with a step shape on the lower surface thereof and a step portion 21A stretching toward the terminal-aligning direction at the front part thereof. As shown in the same drawing, the secondary shield plate 40 connected to a ground circuit (not shown) is attached onto the depression 21B on the lower surface of the main body 21 so as to cover the depression 21B. Further, the frontend edge of the secondary shield plate 40 abuts against the step portion 21A. The secondary shield plate 40 covers the whole circumference of the main body 21, together with the shield plate 30 covering the upper surface and the side surfaces of the main body 21.

In the present embodiment, the secondary shield plate 40 is bent into a U-shape (not shown) viewed from the front in connecting direction of the connectors. Side surfaces of the secondary shield plate 40 (walls on both ends in a direction perpendicular to the sheet) stretch in parallel to the side surfaces of the shield plate 30 so as to overlap therewith. Inner side surfaces of the secondary shield plate 40 contacts outside of outer side surfaces of the shield plate 30 with planes. Thus, the secondary shield plate 40 also makes the shield plate 30 connect to ground by the contact with planes.

In the present embodiment, the cover case 50 is configured so as to be able to separate top and bottom parts and as shown in FIG. 2, and sandwiches the main body 21 of the housing 20 to which the shield plate 30 and the secondary shield plate 40 are fixed.

Next, an operation or connecting the male connector 1 and the female connector 2 will be explained.

Figure 5:
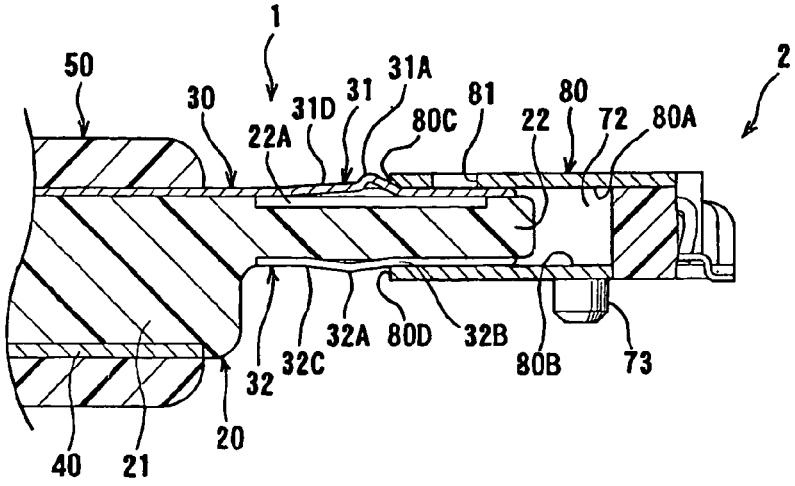
Figure 5:
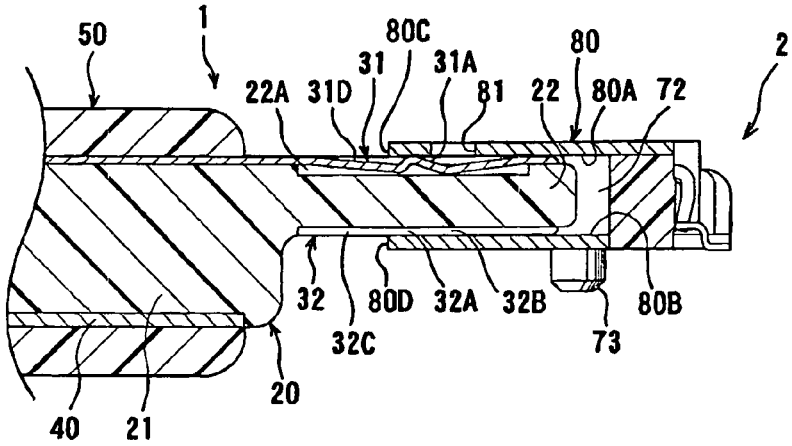
Figure 5:
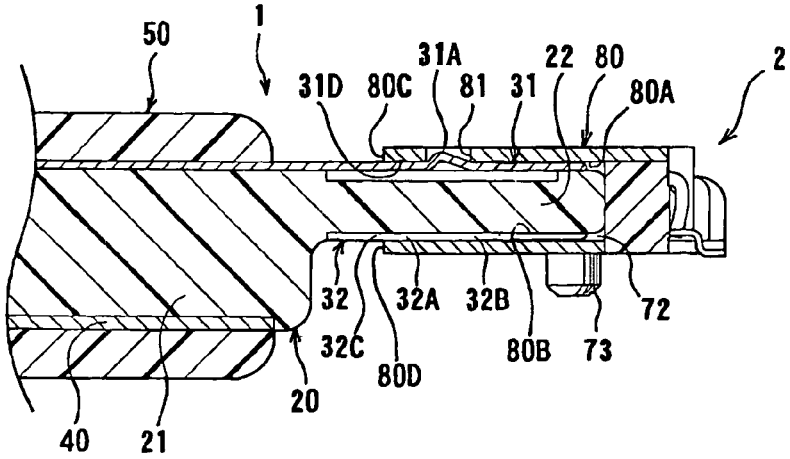

FIGS. 5(A), 5(B) and 5(C) are drawings in order to explain the connecting operation and are sectional views taken along a line 5 in FIG. 1, in which the male connector 1 is shown with the female connector 2. More specifically, FIG. 5(A) shows when the connectors start connecting, FIG. 5(B) shows the halfway of the connecting and FIG. 5(C) shows when the connectors are connected completely. FIGS. 5(A), 5(B), and 5(C) are sectional views taken at a position of the lock portion 31 in the terminal-aligning direction, thus have a different section from that in FIG. 2 showing the sectional view taken at the position of the terminals 10.

As shown in FIG. 5(A), when the male connector 1 moves in the connecting direction (forward) and an insertion of the connecting part of the male connector 1 into the connecting opening 72 of the female connector 2 begins, the protrusion 31A of the lock portion 31 abuts against an upper frontend edge 80C of the female connector 2.

In the present embodiment, as described above, the shield case 30 includes the flat surfaces at the front part of the protrusion 31A of the lock portion 31 on the upper surface thereof and at a front part of base portion 32B of the elastic pressing portion 32 on the lower surface thereof. Additionally, inner surface of the shield plate 80 forming the connecting opening 72 of the female connector 2, namely both of upper surface BOA and lower side 80B of an inside of the connecting part, is also formed as flat surfaces toward the connecting direction of the connectors. Accordingly, the flat surfaces at the upper and lower surfaces of the shield case 30 and the inside of the connecting part of the connecting opening 72 are extend in parallel to each other.

As a result, after starting the insertion of the connector, the flat surfaces of the shield case 30 and the connecting opening 72 of the female connector 2 can move against each other smoothly, thereby making it easy to insert the connecting part of the male connector 1. Accordingly, it is possible to reduce a frictional resistance generated through the contact to each other until the protrusion 31A abuts against the upper frontend edge 80C.

When the connecting operation of the connectors proceeds further, the protrusion 31A of the lock portion 31 slides and presses the upper frontend edge 80C of the female connector 2. Accordingly, the protrusion 31A of the lock portion 31 displaces downward elastically by receiving a reaction force from the upper frontend edge 80C to enter the connecting opening 72 (refer to FIG. 5(B)).

As a result, the protrusion 31A presses against with the upper frontend edge 80C each other inside the connecting opening 72, thereby maintaining a state of elastic the displacement. In the present embodiment, in the connecting part of the male connector 1, the depressed portion 22A extending in the connecting direction of the connectors is formed on the upper surface of the terminal arrangement board 22 at a position corresponding to the lock portion 31. Therefore, as shown in FIG. 5(B), when the protrusion 31A of the lock portion 31 is displaced downward elastically, the protrusion 31A is placed into the depressed portion 22A.

After the protrusion 31A of the lock portion 31 formed on the upper surface of the shield case 30 abuts against the upper frontend edge 80C of the female connector 2, the slope at the front part of the elastic pressing portion 32, i.e., the slope between the top part 32A protruding downward and the base portion 32B formed on the lower side of the shield case 30 abuts against a lower frontend edge 80D of the female connector 2. Hereafter, the elastic pressing portion 32 slides and presses against the lower frontend edge 80D to displace upward elastically, so that the elastic pressing portion 32 becomes an approximate flat shape and enters the connecting opening 72. Accordingly, it is possible to maintain a state in which the top part 32A presses against the lower end edge 80B to elastically displace and has the approximate flat shape shown in FIG. 5(B).

During the connecting operation, when the protrusion 31A of the lock portion 31 and the top part 32A of the elastic pressing portion 32 elastically displace, respectively, a resistance force against an operating force toward the connecting direction is generated in a direction opposite to the connecting direction of the connectors. If the top part of the protrusion 31A is arranged at a position the same as that of the top part 32A of the elastic pressing portion 32 in the connecting direction of the connectors, both top parts abut against the front end of the female connector 2 at the same time, thereby increasing the resistance force due to the two places abutting concurrently.

In the present embodiment, as described above, the top part of the protrusion 31A of the lock portion 31 is shifted from the top part 32A of the elastic pressing portion 32 in the connecting direction of the connectors. The top part of the protrusion 31A of the lock portion 31 is positioned in the front of the top part 32A of the elastic pressing portion 32 by a gap P in the connecting direction of the connectors. Accordingly, the protrusion 31A and the top part 32A of the elastic pressing portion 32 abut against the front end of the female connector 2 at different timings. Accordingly, it is possible to reduce the resistance force generated during the connecting operation of the connectors as compared to the case that the both top parts abut against the front end of the female connector 2 at the same time as described above, thereby making the connecting operation of the connectors easier.

In the present embodiment, the top part of the protrusion 31A is arranged in the front of the top part 32A of the elastic pressing portion 32. Alternatively, the top part 32A of the elastic pressing portion 32 may be arranged in the front of the top part of the protrusion 31A. When the top parts are arranged in this way, each of the top parts still can abut against the front end of the female connector 2 at different timings, thereby reducing the resistance force.

When the connecting operation of the connectors proceeds further, and the protrusion 31A of the lock portion 31 reaches a latching pit 81 formed on the upper surface of the inside of the connecting-part, the protrusion 31A is released from the elastic displacement. As a result, the protrusion 31A fits to the latching pit 81 returning from the elastic displacement as shown in FIG. 5(C), thereby completing the connecting operation. The protrusion 31A fits to the latching pit 81, so that the protrusion 31A engages the inner surface having the latching pit 81 in the connecting direction of the connectors, thereby preventing the connectors from coming off. In addition, when the connectors are completely connected to each other, the elastic pressing portion 32 displaces elastically so as to press a lower inner surface 80B of the connecting part. Accordingly, a distance between the connectors in the up-and-down direction, in other words, a play can be absorbed, so that the protrusion 31A of the lock portion 31 is latched with the latching pit 81 in a secure state, thereby increasing the latching force of the lock portion 31.

As explained already, the lock portion 31 has the slope 31D between the protrusion 31A and the base portion 31C at the rear of the protrusion 31A. As shown in FIG. 5(C), the slope 31D receives the reaction force from the inner upper surface 80A of the connecting part, and does not go back to free state even after the elastic displacement of the protrusion 31A is released.

Accordingly, the inside of the connecting part of the female connector 2 is not only pressed by the elastic pressing portion 32 at the lower side 80B thereof, but also pressed constantly by the slope 31D of the lock portion 31 at the upper surface 80A thereof in an opposite direction of the pressing force of the elastic pressing portion 32, thereby stably maintaining the connection state of the connectors. As a result, the latching force of the lock portion 31 increases furthermore, thereby preventing the connectors from coming off.

In the present embodiment, the metal plate of the lock portion 31 and the elastic pressing portion 32 is also used as the shield plate. As a modification, it is possible to have a metal member other than the metal plate so that the metal member may have a shielding function while the metal plate does not have the shielding function.

In the present embodiment, as shown in FIG. 3, the terminal arrangement board 22 has the upside down U-shape section, and the lower recess portion thereof becomes the terminal aligning surface. The shield plate 30 is attached to the terminal arrangement board 22 so as to cover the upper surface, the side surfaces, and the lower surface except the terminal arrangement area to form the connecting part. As a modification of the connecting part, the shield plate may be formed into a rectangular shape viewed from the front in the connecting direction of the connectors, so that the shield plate covers the whole circumference of the terminal arrangement board having the upside down U-shape. In this case, at the lower side of the shield plate, the shield plate covers the terminal arrangement area, where the shield plate does not exist in FIG. 3. An opening is formed between the shield plate and the terminal arrangement board for receiving the corresponding part of the female connector as the mating connector.

As a further modification, it is possible that the shield plate is formed into a rectangular shape viewed from the front in the connecting direction of the connectors to cover the whole circumference of the terminal arrangement board with a gap. The terminal arrangement board may be arranged in an island shape relative to the shield plate, and an opening may be formed between the whole outer circumference of the terminal arrangement board and the inner circumference of the shield plate for receiving the corresponding part of the female connector.

What is claimed is:

1. An electrical connector to be connected to a mating connector in a first direction, comprising:

a housing;

a plurality of terminals;

a terminal arrangement board formed of an electrical insulator for arranging and holding the terminals; and a metal plate attached to the housing at a position facing both surfaces of the terminal arrangement board for fitting to the mating connector, said metal plate having a lock portion at a position facing to one of the surfaces of the terminal arrangement board for engaging a latch portion of the mating connector in the first direction when the electrical connector is connected to the mating connector, said metal plate having an elastic pressing portion at a position facing the other of the surfaces of the terminal arrangement board for pressing the mating connector in a second direction perpendicular to the first direction when the electrical connector is connected to the mating connector.

2. The electrical connector according to claim 1, wherein said lock portion includes a protrusion for engaging the latch portion of the mating connector in the first direction when the electrical connector is connected to the mating connector, said elastic pressing portion including a top part for pressing an inner surface of the mating connector to displace elastically when the electrical connector is connected to the mating connector, said protrusion being shifted from the top part of the elastic pressing portion in the first direction.

3. The electrical connector according to claim 2, wherein said metal plate includes a flat surface extending in parallel to the inner surface of the mating connector at a front side of the protrusion of the lock portion in the first direction and at a front side of the elastic pressing portion in the first direction.

4. The electrical connector according to claim 1, wherein said lock portion is formed of a both end fixed beam type spring, said lock portion including both base portions shifted front and rear in the first direction.

5. The electrical connector according to claim 4, wherein said lock portion includes a slope inclined from one of the base portions toward the protrusion in a direction that the protrusion protrudes between the protrusion and the one of the base portions located at a rear side in the first direction.

6. The electrical connector according to claim 1, wherein said elastic pressing portion is formed of a both end fixed beam type spring, said elastic pressing portion including both base portions shifted front and rear in the first direction.

* * * * *